US010933652B2

(12) United States Patent
Ishikawa

(10) Patent No.: US 10,933,652 B2
(45) Date of Patent: Mar. 2, 2021

(54) LIQUID CIRCULATION DEVICE AND LIQUID DISCHARGING APPARATUS

(71) Applicant: TOSHIBA TEC KABUSHIKI KAISHA, Tokyo (JP)

(72) Inventor: Hiroyuki Ishikawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/674,409

(22) Filed: Nov. 5, 2019

(65) Prior Publication Data

US 2020/0070536 A1 Mar. 5, 2020

Related U.S. Application Data

(63) Continuation of application No. 15/598,814, filed on May 18, 2017, now Pat. No. 10,538,098, which is a (Continued)

(30) Foreign Application Priority Data

Dec. 27, 2013 (JP) ..... JP2013-271629

(51) Int. Cl.
*B41J 2/18* (2006.01)
*B41J 2/175* (2006.01)
*B41J 2/19* (2006.01)

(52) U.S. Cl.
CPC ..... *B41J 2/18* (2013.01); *B41J 2/175* (2013.01); *B41J 2/17513* (2013.01); (Continued)

(58) Field of Classification Search
CPC . B41J 2/18; B41J 2/175; B41J 2/17563; B41J 2/17559; B41J 2/17596; B41J 2/19; B41J 2202/00
See application file for complete search history.

(56) References Cited

U.S. PATENT DOCUMENTS 6,082,851 A 7/2000 Shihoh et al.
6,257,712 B1 7/2001 Haigo
(Continued)

FOREIGN PATENT DOCUMENTS

JP 2000280493 A 10/2000
JP 2003145782 A 5/2003
(Continued)

OTHER PUBLICATIONS

Japanese Office Action dated Mar. 23, 2018, filed in Japanese counterpart Application No. 2017-121390, 6 pages (with translation).

*Primary Examiner* — Matthew Luu
*Assistant Examiner* — Kendrick X Liu
(74) *Attorney, Agent, or Firm* — Kim & Stewart LLP

(57) ABSTRACT

A liquid circulation device includes a housing having an outlet and an inlet, a circulation unit configured to convey liquid out of the housing through the outlet and recover liquid into the housing through the inlet, a liquid supplying unit configured to supply liquid into the housing, an air conveying unit configured to convey air into and out of the housing, a level detecting unit configured to detect a level of the liquid in the housing, a pressure sensing unit configured to detect a pressure of the air in the housing, and a control unit configured to control a pressure of the liquid in the housing by controlling the liquid supplying unit or the air conveying unit, based on the level and the pressure of the air.

8 Claims, 9 Drawing Sheets

Related U.S. Application Data continuation of application No. 15/215,471, filed on Jul. 20, 2016, now Pat. No. 10,525,723, which is a continuation of application No. 14/584,913, filed on Dec. 29, 2014, now Pat. No. 9,421,788.

(52) U.S. Cl.
CPC ..... *B41J 2/17559* (2013.01); *B41J 2/17563* (2013.01); *B41J 2/17566* (2013.01); *B41J 2/17596* (2013.01); *B41J 2/19* (2013.01); *B41J 2202/12* (2013.01)

(56) References Cited

U.S. PATENT DOCUMENTS

| | | | | |
|---|---|---|---|---|
| 8,128,212 | B2 | 3/2012 | Katada et al. | |
| 8,292,396 | B2 | 10/2012 | Yamada | |
| 9,421,788 | B2 | 8/2016 | Ishikawa | |
| 2007/0252860 | A1 | 11/2007 | Nitta et al. | |
| 2008/0231650 | A1 | 9/2008 | Kojima et al. | |
| 2009/0284563 | A1 | 11/2009 | Bansyo | |
| 2009/0284572 | A1* | 11/2009 | Katoh | B41J 2/17513 347/85 |
| 2010/0013883 | A1 | 1/2010 | Nishimura et al. | |
| 2010/0039460 | A1 | 2/2010 | Delueg | |
| 2010/0289857 | A1 | 11/2010 | Bennett | |
| 2011/0050794 | A1 | 3/2011 | Koike et al. | |
| 2011/0063381 | A1 | 3/2011 | Nitta et al. | |
| 2011/0279495 | A1 | 11/2011 | Kuribayashi et al. | |
| 2012/0062639 | A1 | 3/2012 | Nitta | |
| 2012/0105520 | A1 | 5/2012 | Shimoda et al. | |
| 2012/0180315 | A1 | 7/2012 | Shimosato | |
| 2012/0188314 | A1* | 7/2012 | Akiyama | B41J 2/18 347/85 |
| 2014/0125745 | A1 | 5/2014 | Igawa | |

FOREIGN PATENT DOCUMENTS

| | | | |
|---|---|---|---|
| JP | 2005125670 | A | 5/2005 |
| JP | 2007313884 | A | 12/2007 |
| JP | 2009101516 | A | 5/2009 |
| JP | 2010264678 | A | 11/2010 |
| JP | 2012091527 | A | 5/2012 |

* cited by examiner

LIQUID CIRCULATION DEVICE AND LIQUID DISCHARGING APPARATUS

CROSS-REFERENCE TO RELATED APPLICATIONS

This application is a continuation of U.S. patent application Ser. No. 15/598,814, filed on May 18, 2017, which is a continuation of U.S. patent application Ser. No. 15/215,471, filed on Jul. 20, 2016, which is a continuation of U.S. patent application Ser. No. 14/584,913, filed on Dec. 29, 2014, now U.S. Pat. No. 9,421,788, issued on Aug. 23, 2016, which is based upon and claims the benefit of priority from Japanese Patent Application No. 2013-271629, filed Dec. 27, 2013, the entire contents of each of which are incorporated herein by reference.

FIELD

Embodiments described herein relate generally to a liquid circulation device and a liquid discharging apparatus.

BACKGROUND

A liquid discharging apparatus, such as an inkjet apparatus, discharges liquid towards a medium from nozzles of a head. One type of the liquid discharging apparatus circulates the liquid between a liquid tank and the head, and bubbles and foreign bodies included in the liquid are removed from the liquid during the circulation. According to a related art, when the liquid in the liquid tank is used up, new liquid is supplied to the liquid tank from an auxiliary liquid tank. However, in order to supply the new liquid into the liquid tank, the discharging of the liquid from the nozzles to the medium (e.g., for printing) has to be interrupted. When the size of the liquid tank is small, the discharging of the liquid may be frequently interrupted and, as a result, time-efficient discharging may not be performed.

DETAILED DESCRIPTION

One or more embodiments are directed to provide a liquid circulation device, an inkjet apparatus, and a method for operating the inkjet apparatus that improve productivity of liquid discharge by preventing a liquid discharge operation from being stopped due to refilling a liquid tank with new liquid in which liquid is circulated between the liquid tank and a liquid discharge unit.

In general, according to one embodiment, a liquid circulation device includes a housing having an outlet and an inlet, a circulation unit configured to convey liquid out of the housing through the outlet and recover liquid into the housing through the inlet, a liquid supplying unit configured to supply liquid into the housing, an air conveying unit configured to convey air into and out of the housing, a level detecting unit configured to detect a level of the liquid in the housing, a pressure sensing unit configured to detect a pressure of the air in the housing, and a control unit configured to control a pressure of the liquid in the housing by controlling the liquid supplying unit or the air conveying unit, based on the level and the pressure of the air.

Figure 1:
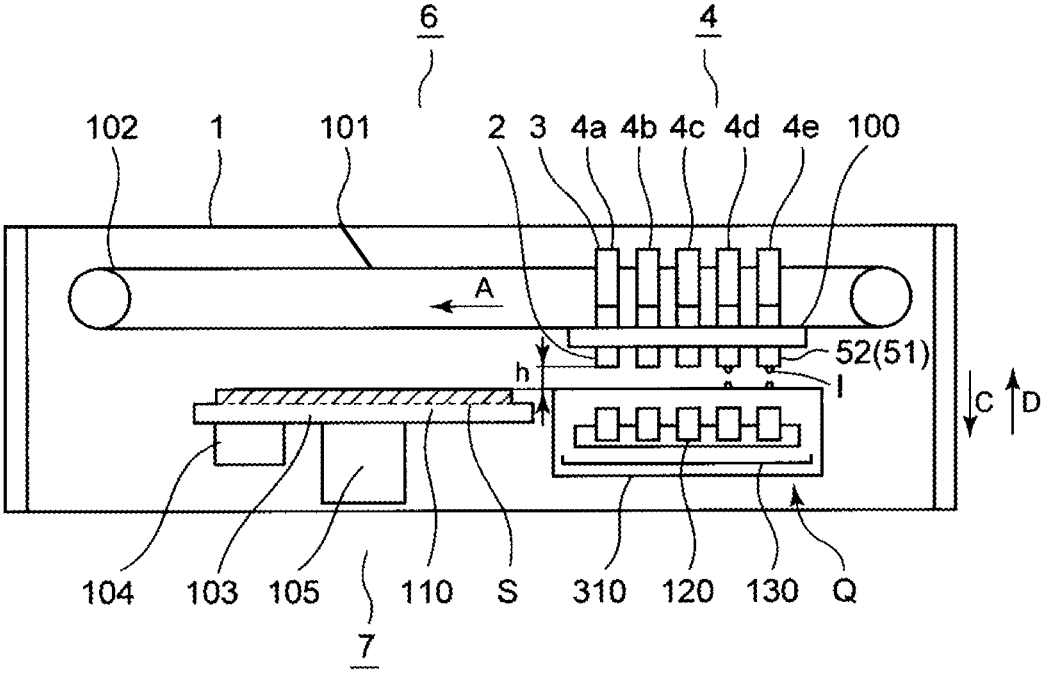
FIG. 1 is a schematic front view of a liquid discharging apparatus (an inkjet apparatus) according to an embodiment.
Figure 2:
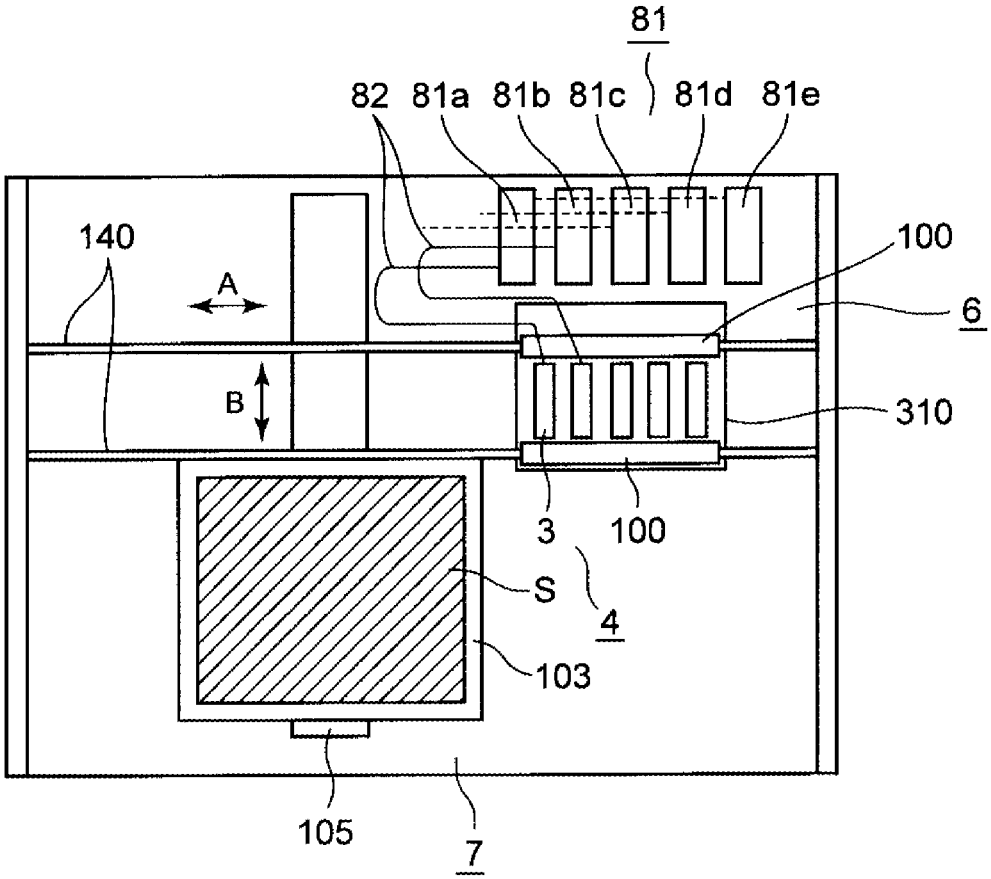
FIG. 2 is a schematic plan view of the inkjet apparatus according to the embodiment.

An inkjet recording apparatus 1 that is a liquid discharge recording apparatus according to an exemplary embodiment will be described with reference to FIG. 1 to FIG. 10. FIG. 1 and FIG. 2 illustrate one example of the inkjet recording apparatus 1. The inkjet recording apparatus 1 includes an image forming unit 6, a recording medium moving unit 7 that is a transport unit, and a maintenance unit 310. The image forming unit 6 includes an inkjet recording unit 4, a carriage 100 that supports the inkjet recording unit 4, a transport belt 101 that reciprocally moves the carriage 100 in an arrow A direction, and a carriage motor 102 that drives the transport belt 101.

The inkjet recording unit 4 includes an inkjet head 2 that is a liquid discharge unit and is an ink discharge unit, and an ink circulation device 3 that is a circulation unit. The ink circulation device 3 is disposed above the inkjet head 2 and is integrated with the inkjet head 2. The inkjet recording unit 4 discharges ink onto a recording medium S and forms a desired image.

The inkjet recording unit 4, for example, includes inkjet recording units 4*a*, 4*b*, 4*c*, 4*d*, and 4*e* that respectively discharge a cyan ink, a magenta ink, a yellow ink, a black ink, and a white ink. Colors or characteristics of the ink that the inkjet recording units 4*a*, 4*b*, 4*c*, 4*d*, and 4*e* respectively use are not limited. For example, the inkjet recording unit 4*e* may discharge a transparent glossy ink, which is a special ink that is colored when irradiated with an infrared ray or an ultraviolet ray, and the like instead of a white ink. The inkjet recording units 4*a*, 4*b*, 4*c*, 4*d*, and 4*e* will be described using a common numeral 4 because these have the same configuration except for the color of the ink used.

The width of the inkjet recording unit 4 can be narrowed by disposing the ink circulation device 3 on the inkjet head 2. Accordingly, the width of the carriage 100 that supports the plurality of inkjet recording units 4*a* to 4*e* in a parallel manner can be narrowed. The transport distance of the carriage 100 can be decreased by narrowing the width of the carriage 100, and as the transport distance can be decreased, the inkjet recording apparatus 1 may become smaller and the print speed may be improved.

The image forming unit 6 includes an ink cartridge 81 for refilling the ink circulation device 3 with new ink. Inkjet cartridges 81*a*, 81*b*, 81*c*, 81*d*, and 81*e* of the ink cartridge 81 respectively contain a cyan ink, a magenta ink, a yellow ink, a black ink, and a white ink. The inkjet cartridges 81*a*, 81*b*, 81*c*, 81*d*, and 81*e* will be described using a common numeral 81 because of having the same configuration except for each different ink contained. Each of the ink cartridges 81 communicates with the corresponding ink circulation device 3 of the inkjet recording unit 4 through a tube 82.

Each of the ink cartridges 81 is disposed relatively below the corresponding ink circulation device 3 in the direction of the gravitational force.

The recording medium moving unit 7 includes a table 103 that fixes the recording medium S by suction. The table 103 reciprocally moves in an arrow B direction while attached on a slide rail 105. The table 103 sucks the recording medium S from a hole 110 with a small diameter formed on the upper surface of the table 103 to fix the recording medium S by negatively pressurizing the inside of a pump 104. The distance h between a nozzle plate 52 of the inkjet head 2 and the recording medium S is maintained to be constant while the inkjet recording unit 4 reciprocally moves in the arrow A direction along the transport belt 101. The inkjet head 2 includes 300 nozzles 51, which are the liquid discharge unit, in the longitudinal direction of the nozzle plate 52. The longitudinal direction of the nozzle plate 52 is parallel to the transport direction of the recording medium S.

The image forming unit 6 forms an image on the recording medium S while the inkjet head 2 reciprocally moves in a direction orthogonal to the transport direction of the recording medium S. The inkjet head 2 discharges an ink I from the nozzles 51 disposed in the nozzle plate 52 in response to an image forming signal to form an image on the recording medium S. The inkjet recording unit 4 forms an image with the width thereof corresponding to, for example, 300 nozzles on the recording medium S.

The maintenance unit 310 is disposed at a position that is outside the moving range of the table 103 and in the scanning range of the inkjet recording unit 4 in the arrow A direction. The inkjet head 2 is opposite to the maintenance unit 310, when the inkjet head 2 is at a standby position Q. The maintenance unit 310 is an open-top case and is disposed to be movable up and down (direction of arrows C and D in FIG. 1).

The maintenance unit 310 moves downward (arrow C direction) to be apart from the nozzle plate 52 when the carriage 100 moves in the arrow A direction to print an image. The maintenance unit 310 moves upward (arrow D direction) when the printing operation ends. When the printing operation ends, and the inkjet head 2 returns to the standby position Q, the maintenance unit 310 moves upward to cover the nozzle plate 52 of the inkjet head 2. The maintenance unit 310 prevents ink from evaporating from the nozzle plate 52 and prevents dirt or paper dust from sticking to the nozzle plate 52. The maintenance unit 310 has a function of capping the nozzle plate 52.

The maintenance unit 310 includes a rubber blade 120 and a waste ink reception unit 130. The rubber blade 120 removes ink, dirt, paper dust, and the like that stick to the nozzle plate 52 of the inkjet head 2. The waste ink reception unit 130 receives waste ink, dirt, paper dust, and the like during the maintenance operation. The maintenance unit 310 includes a mechanism that moves the blade 120 in the arrow B direction to sweep out the outer surface of the nozzle plate 52 by the blade 120.

The inkjet head 2 performs maintenance (spitting function) that forcibly discharges ink from the nozzles 51 to remove ink that has deteriorated in the vicinity of the nozzles. The inkjet head 2 performs maintenance (purging function) that allows a small amount of ink to flow out of the nozzles 51 so that dirt or paper dust that stick to the outer surface of the inkjet head 2 may be captured in the surface of the ink that flows out and may be wiped out by the blade 120. The waste ink reception unit 130 receives waste ink after the spitting function or the purging function is performed.

The inkjet recording apparatus 1 forms an image on the recording medium S by discharging ink from the nozzles 51 while the inkjet head 2 reciprocally moves in the direction orthogonal to the direction of the recording medium S transported by the recording medium moving unit 7.

The structure of the inkjet recording apparatus 1 is not limited. For example, the inkjet recording apparatus 1, without using the table 103 to move the recording medium, may be an apparatus that moves a roll-shaped recording medium in a direction perpendicular to the moving direction of the inkjet recording unit 4 by winding up the roll-shaped recording medium. Alternatively, the inkjet recording apparatus 1 may be an apparatus that moves a sheet-shaped recording medium in the direction perpendicular to the moving direction of the inkjet recording unit 4 using a platen roller.

Figure 3:
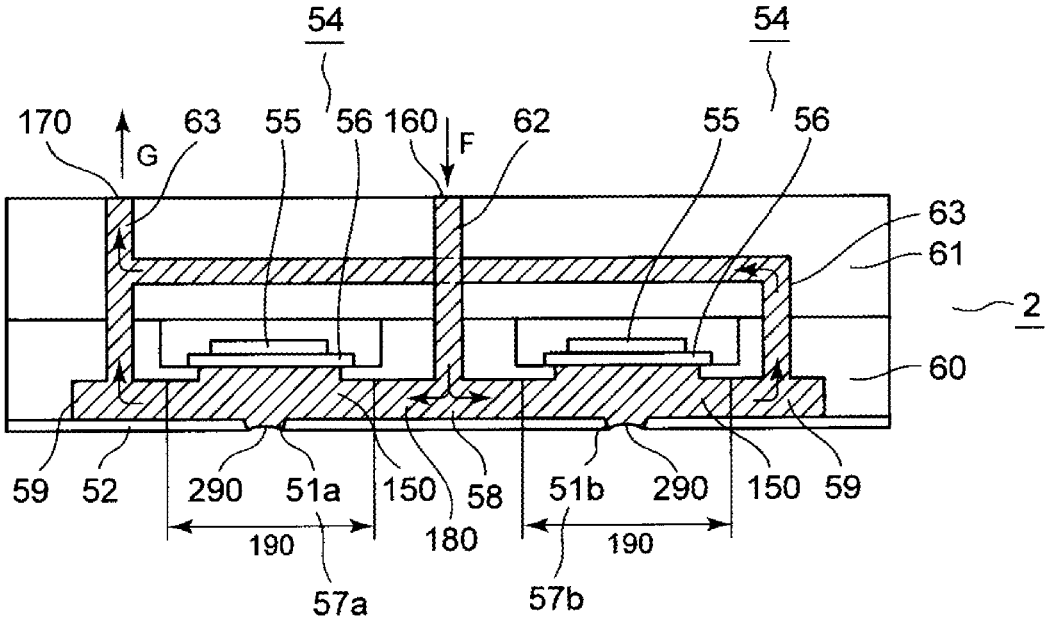
FIG. 3 is a cross sectional view of an inkjet head of the inkjet apparatus according to the embodiment.

The inkjet recording unit 4 will be described in detail. The inkjet head 2 of the inkjet recording unit 4, for example, includes the nozzle plate 52 that includes the nozzles 51, a board 60 that includes an actuator 54, and a manifold 61 that is connected to the board 60 as illustrated in FIG. 3. The board 60 includes an ink flow passage 180 through which ink flows between the nozzles 51 and the actuator 54. The actuator 54 is provided to abut the ink flow passage 180 and is provided corresponding to each nozzle 51.

The board 60 includes a boundary wall 190 between the adjacent nozzles 51 so that a pressure applied to ink in the ink flow passage 180 by the actuator 54 can extend to the ink at the nozzles 51. The ink flow passage 180 surrounded by the nozzle plate 52, the actuator 54, and the boundary wall 190 forms an ink pressure chamber 150. The ink pressure chamber 150 is disposed corresponding to each nozzle 51*a* in a first nozzle row 57*a* and corresponding to each nozzle 51*b* in a second nozzle row 57*b*. The first nozzle row 57*a* and the second nozzle row 57*b* respectively include 300 nozzles 51*a* and 300 nozzles 51*b*.

The board 60 includes a common ink supply chamber 58 to supply ink into the ink flow passage 180 of a plurality of ink pressure chambers 150. The board 60 includes common ink chambers 59 to recover ink from a plurality of ink flow passages 180 respectively on the first nozzle row 57*a* side and the second nozzle row 57*b* side.

The manifold 61 includes an ink supply port 160 from which ink flows in an arrow F direction and an ink exhaust port 170 from which ink is discharged in an arrow G direction. The ink I is supplied to the ink supply port 160 from the ink circulation device 3. The ink exhaust port 170 allows ink to flow back into the ink circulation device 3. The manifold 61 includes an ink distribution passage 62 that connects between the common ink supply chamber 58 and the ink supply port 160. The manifold 61 includes an ink circulation flow passage 63 that connects between the ink exhaust port 170 and the common ink chamber 59.

Flowing through the ink distribution passage 62 in the arrow F direction, the ink I flows into the plurality of ink pressure chambers 150 from the common ink supply chamber 58. The ink I that is not discharged from the nozzles 51 in the ink pressure chamber 150 flows into the common ink chamber 59 and flows into the ink circulation flow passage 63.

The actuator 54 of the inkjet head 2, for example, is a unimorph-type piezoelectric vibration plate including a piezoelectric element 55 and a vibration plate 56 laminated thereon. The piezoelectric element 55, for example, is formed of a piezoelectric ceramic material such as a lead zirconate titanate (PZT). The vibration plate 56, for example, is formed of a silicon nitride (SiN) and the like.

Figure 4:
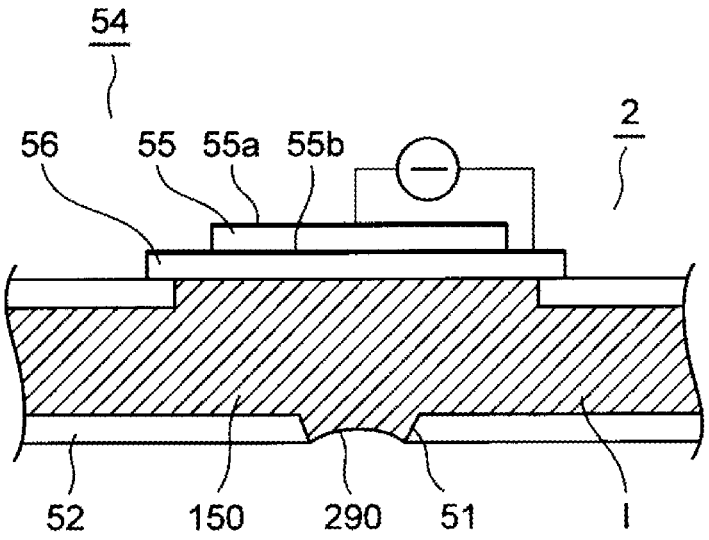
FIG. 4 is an enlarged view of a nozzle of the inkjet head when ink remains in the nozzle.
Figure 5:
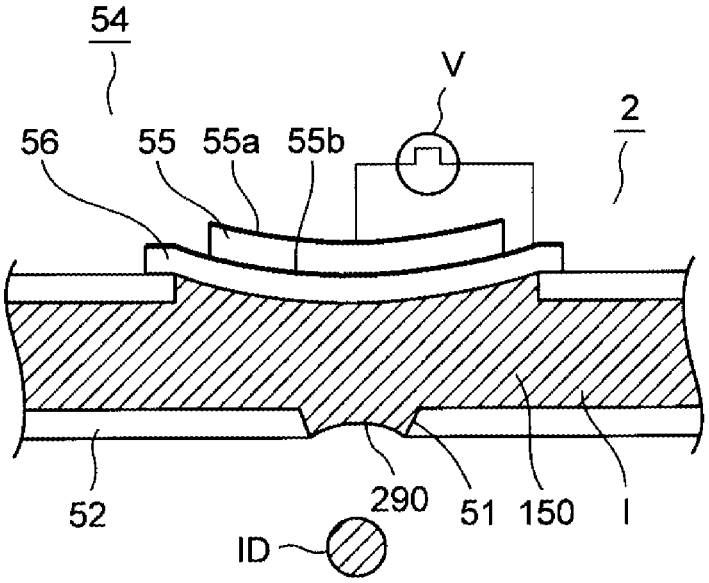
FIG. 5 is an enlarged view of the nozzle when an ink droplet is discharged from the nozzle.

The piezoelectric element 55 includes electrodes 55*a* and 55*b* on upper and lower surfaces thereof as illustrated in FIG. 4 and FIG. 5. The actuator 54 is not deformed when a voltage is not applied between the electrodes 55*a* and 55*b* since the piezoelectric element 55 is not deformed as illustrated in FIG. 4. A meniscus 290 that is an interface between the ink I and an external space is formed in the nozzles 51 according to the surface tension of the ink when the actuator 54 is not deformed. The ink I in the ink pressure chamber 150 remains in the nozzles 51 while the meniscus 290 is maintained.

The actuator 54 is deformed as illustrated in FIG. 5 when the piezoelectric element 55 is deformed in response to application of a voltage (V) between the electrodes 55*a* and 55*b*. When a pressure applied to the ink at the meniscus 290 is increased over the atmospheric pressure (positive pressure) by the deformed actuator 54, the ink I breaks through the meniscus 290 and discharged from the nozzles 51 as an ink droplet ID.

The structure of the inkjet head 2 is not limited as long as the pressure of the ink in the ink pressure chamber can be changed. The inkjet head, for example, may have a structure in which ink droplets are discharged according to deformation of the vibration plate by static electricity. Alternatively, the inkjet head may have a structure in which ink droplets are discharged from the nozzles using heat energy of a heater. In addition, the inkjet head may include a temperature sensor used to favorably control the ink discharge because the viscosity of the ink changes depending on the temperature of the ink and thus discharging characteristics from the nozzles change.

Figure 6:
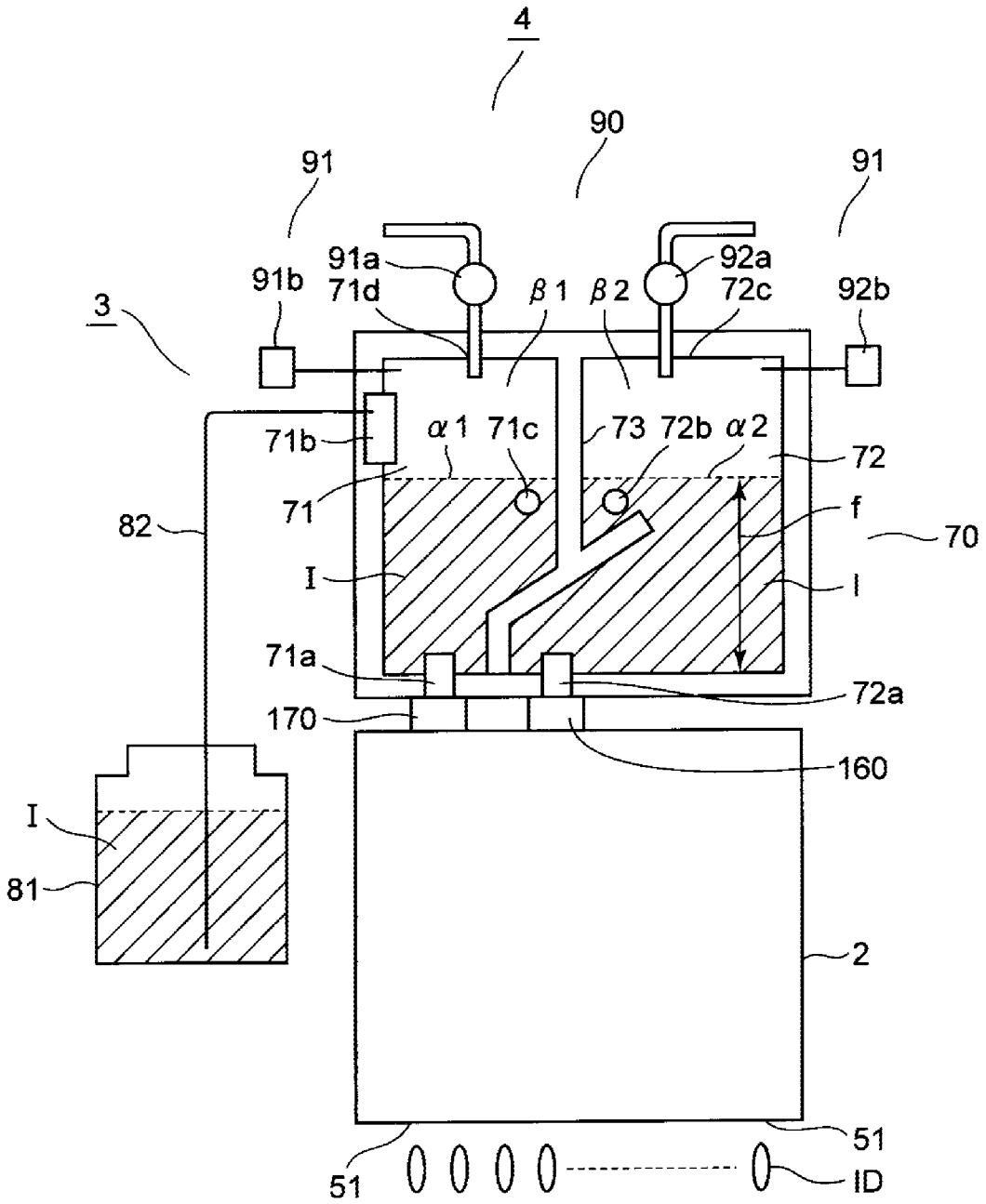
FIG. 6 is a schematic view of an ink circulation device of the inkjet apparatus according to the embodiment.
Figure 7:
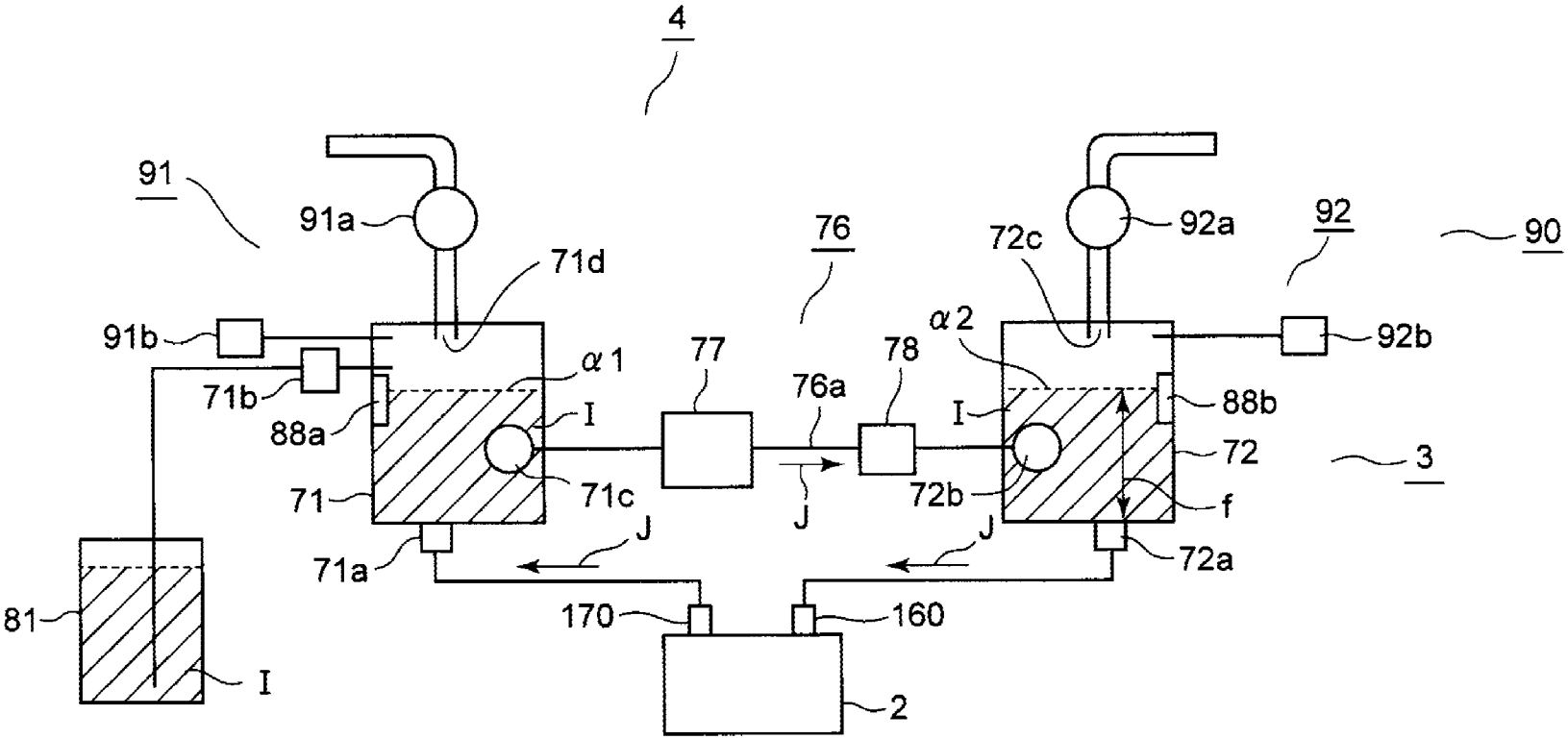
FIG. 7 illustrates circulation of the ink through the ink circulation device.

The ink circulation device 3 of the inkjet recording unit 4, for example, includes an ink casing 70 that is a liquid chamber, an ink circulation unit 76, and a pressure adjustment unit 90 that is an air refill unit as illustrated in FIG. 6 and/or FIG. 7. The ink circulation device 3 circulates ink and supplies the ink to the inkjet head 2, and adjusts the pressure of the ink in the ink pressure chamber 150 of the inkjet head 2. The ink circulation device 3 adjusts the pressure of the ink in the ink pressure chamber 150 to adjust the pressure of the ink at the meniscus 290 formed in the nozzles 51. The ink circulation device 3 supplies the ink to the inkjet head 2 to remove bubbles or foreign bodies included in the ink I.

The inkjet head 2 discharges the ink I from the nozzles 51 when the pressure of the ink at the meniscus 290 formed in the nozzles 51 is higher than the atmospheric pressure (positive pressure). The meniscus 290 is maintained and the ink I remains in the nozzles 51 when the pressure of the ink at the meniscus 290 is lower than the atmospheric pressure (negative pressure). For example, the inkjet head 2 does not discharge ink from the nozzles 51 as the meniscus 290 is maintained, when the pressure of the ink inside the ink pressure chamber 150 is adjusted to −4.0 kPa to −0.5 kPa.

The ink I, for example, is discharged from the nozzles 51 in response to a slight vibration and the like when the nozzles 51 are disposed to discharge the ink I in the direction of the gravitational force (downward direction), and the pressure of the ink inside the ink pressure chamber 150 is higher than −4.0 kPa to −0.5 kPa (positive pressure side). Failure of the ink discharge is caused due to sucking the air from the nozzles 51 when the pressure of the ink inside the ink pressure chamber 150 is lower than −4.0 kPa to −0.5 kPa (negative pressure side). The ink circulation device 3 prevents unnecessary ink discharge or the air sucking by maintaining the pressure of the ink at the meniscus 290 between −4.0 kPa and −0.5 kPa.

The ink casing 70 includes an ink collection chamber 71 to collect the ink I from the inkjet head 2 and an ink supply chamber 72 to supplies the ink I to the inkjet head 2. The ink collection chamber 71 and the ink supply chamber 72 are adjacent to each other with a common wall 73 disposed therebetween. The ink casing 70 is airtight with respect to the outside air. The ink collection chamber 71 and the ink supply chamber 72 contain the ink I respectively under a first liquid surface α1 and a second liquid surface α2. A first air space β1 and a second air space β2 are respectively formed above the first liquid surface α1 and the second liquid surface α2 in the ink collection chamber 71 and the ink supply chamber 72.

The ink collection chamber 71 is connected to the ink exhaust port 170 of the inkjet head 2 and includes an ink return tube 71*a* that allows the ink I to flow back into the ink collection chamber 71 from the inkjet head 2. The ink collection chamber 71 includes an ink supply pump 71*b* for supplying new ink from the ink cartridge 81 through the tube 82. The ink supply pump 71*b* configures a part of an ink refill unit (a liquid refill unit). The ink collection chamber 71 includes a liquid transport hole 71*c* to transport the ink to the ink circulation unit 76. The ink collection chamber 71 includes a first communication hole 71*d* that is connected to a first pressure adjustment unit 91 of the pressure adjustment unit 90.

The ink supply chamber 72 is connected to the ink supply port 160 of the inkjet head 2 and includes an ink supply tube 72*a* that allows the ink I to flow into the inkjet head 2. The ink supply chamber 72 includes an exhaust hole 72*b* from which the ink I transported from the ink circulation unit 76 is exhausted into the ink supply chamber 72. The ink supply chamber 72 includes a second communication hole 72*c* that is connected to a second pressure adjustment unit 92 of the pressure adjustment unit 90.

The structure of the ink collection chamber 71 or the ink supply chamber 72 is not limited provided that the ink may be favorably conveyed between the inkjet head and the ink collection chamber or between the inkjet head and the ink supply chamber. For example, the ink collection chamber or the ink supply chamber may have a heater that heats the ink so as to maintain the temperature of ink to be in a predetermined range.

Disposing the ink cartridge 81 below relative to the ink circulation device 3 in the direction of the gravitational force allows the water head pressure of the ink inside the ink cartridge 81 to be maintained below the set pressure of the ink collection chamber 71. Since the ink cartridge 81 is disposed below the ink circulation device 3, the ink cartridge 81 supplies new ink to the ink collection chamber 71 only when the ink supply pump 71*b* is being driven.

The ink supply pump 71*b*, for example, is a piezoelectric pump. The ink supply pump 71*b* periodically changes the volume inside the pump (volume of a pump chamber) because a piezoelectric vibration plate therein, which is formed by adhering a piezoelectric element to a metal plate, is bent. Changes in the volume of the pump chamber allow the ink supply pump 71*b* to transport ink to the pump chamber from the ink cartridge 81. A non-return valve of the ink supply pump 71*b* sets the transport direction of ink to one direction from the ink cartridge 81 to the ink collection chamber 71. Ink flows into the pump chamber when the pump chamber is expanded by the bending of the piezoelectric vibration plate in the ink supply pump 71*b*. Ink flows out of the pump chamber when the pump chamber is shrunk by the bending of the piezoelectric vibration plate in the ink supply pump 71*b*. Liquid ink is transported from the ink cartridge 81 to the ink collection chamber 71 by repeating the expansion and the shrinkage of the pump chamber in the ink supply pump 71*b*.

The position where the ink cartridge 81 is disposed is not limited. The water head pressure of the ink inside the ink cartridge 81 exceeds the set pressure of the ink collection chamber 71, for example, when the ink cartridge 81 is disposed at a higher position than the ink circulation device 3. In case of disposing the ink cartridge 81 at a higher position than the ink circulation device 3, the ink may be supplied to the ink collection chamber 71 from the ink cartridge 81 by opening and closing a electromagnetic valve using a water head pressure difference.

The ink circulation unit 76 of the ink circulation device 3 includes a circulation passage 76*a* that connects between the liquid transport hole 71*c* of the ink collection chamber 71 and the exhaust hole 72*b* of the ink supply chamber 72 as illustrated in FIG. 7. The ink circulation unit 76 includes a circulation pump 77 and a filter 78 in the circulation passage 76*a*. The circulation pump 77 is disposed between the ink collection chamber 71 and the ink supply chamber 72 that are adjacent to the circulation pump 77. The circulation pump 77, as illustrated using arrows J, circulates the ink I from the ink collection chamber 71 via the ink supply chamber 72 and the inkjet head 2 back to the ink collection chamber 71. The ink circulation unit 76 sucks the ink from the liquid transport hole 71*c* and transports the liquid ink I to the ink supply chamber 72 through the exhaust hole 72*b*. For the circulation pump 77, for example, a tube pump, a diaphragm pump, a piston pump, or the like is used.

The filter 78, for example, is disposed downstream in the circulation direction with respect to the circulation pump 77 of the ink circulation passage 76*a*, and catches foreign bodies that are included in the ink I. For the filter 78, for example, a mesh filter made of such as polypropylene, nylon, polyphenylene sulfide, stainless steel is used.

Bubbles in the ink I rise in a direction (upward direction) opposite to the direction of the gravitational force by buoyancy while the ink I is conveyed from the ink collection chamber 71 to the ink supply chamber 72 by the ink circulation unit 76. The bubbles that rise by buoyancy reach the air spaces β1 or β2 above the first liquid surface α1 of the ink collection chamber 71 or the second liquid surface α2 of the ink supply chamber 72, and are removed from the ink I.

The ink circulation device 3, as illustrated in FIG. 7, includes a first ink amount sensor (liquid surface sensor) 88*a* that measures the amount of ink in the ink collection chamber 71 and a second ink amount sensor (liquid surface sensor) 88*b* that measures the amount of ink in the ink supply chamber 72. The first ink amount sensor (liquid surface sensor) 88*a* or the second ink amount sensor (liquid surface sensor) 88*b*, for example, measures the amount of ink by vibrating a piezoelectric vibration plate using an alternating current voltage and detecting vibrations of ink that are propagated through the ink collection chamber 71 or the ink supply chamber 72. The structure of the ink amount sensor is not limited. The ink amount sensor may have a structure that measures the height of the first liquid surface α1 or the second liquid surface α2.

The ink circulation device 3, as illustrated in FIG. 7, includes a first pressure sensor 91*b* that is disposed corresponding to the first communication hole 71*d* of the ink collection chamber 71 and a second pressure sensor 92*b* that is disposed corresponding to the second communication hole 72*c* of the ink supply chamber 72. The first pressure sensor 91*b* detects the pressure of the first air space β1 in the ink collection chamber 71. The second pressure sensor 92*b* detects the pressure of the second air space β2 in the ink supply chamber 72. The structure of the pressure sensor 91*b* or 92*b* is not limited. The pressure sensor 91*b* or 92*b*, for example, is a semiconductor piezoresistive pressure sensor that outputs the air pressure of the first air space β1 or the second air space β2 as an electric signal. The semiconductor piezoresistive pressure sensor includes a diaphragm that receives an external pressure and a semiconductor strain gage that is formed on the outer surface of the diaphragm. The semiconductor piezoresistive pressure sensor detects a pressure by converting changes in an electrical resistance into an electric signal. The electrical resistance change is caused by a piezoresistive effect that is generated in the strain gage along with the diaphragm deformed by the external pressure.

The first pressure adjustment unit 91 of the ink circulation device 3 includes a first pressure adjustment pump 91*a*, and the second pressure adjustment unit 92 includes a second pressure adjustment pump 92*a*. The first and the second pressure adjustment pumps 91*a* and 92*a* respectively can send air to the ink collection chamber 71 and the ink supply chamber 72, in order to increase the pressure inside the circulation passage 76*a*. The first and the second pressure adjustment pumps 91*a* and 92*a* respectively can discharge air in the ink collection chamber 71 and the ink supply chamber 72 outward to decrease the pressure inside the circulation passage 76*a*. For the pressure adjustment pumps 91*a* and 92*a*, for example, a tube pump, a bellows pump, or the like may be used.

Figure 8:
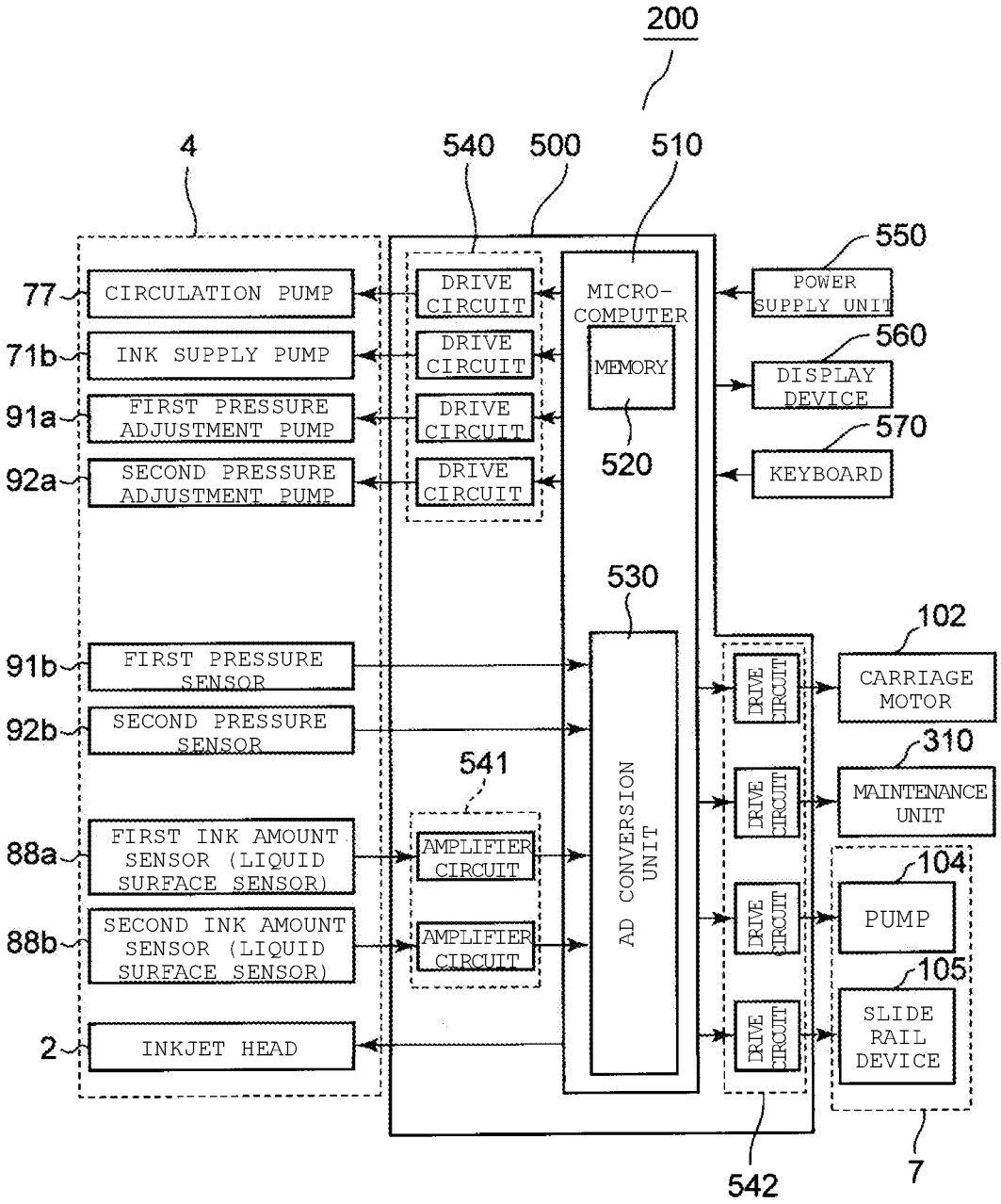
FIG. 8 is a schematic block diagram of a control system of the inkjet apparatus according to the embodiment.

A control system 200 that controls the operation of the inkjet recording apparatus 1 will be described with reference to a block diagram illustrated in FIG. 8. A control board 500 of the control system 200 includes a microcomputer 510 that is a control unit and controls the entire inkjet recording apparatus 1, a recording unit drive circuit 540 that drives the inkjet recording apparatus 1, an amplifier circuit 541, and a moving unit drive circuit 542 that drives the recording medium moving unit 7. The microcomputer 510 includes a memory 520 that stores programs, various data, or the like and an AD conversion unit 530 that receives an output voltage from the inkjet recording unit 4.

The control board 500 is connected to a power supply unit 550, a display device 560 that displays an operational state of the inkjet recording apparatus 1, and a keyboard 570 that is an input device. The control board 500 is connected to a drive unit and a detection unit of the inkjet recording unit 4. The control board 500 is connected to the pump 104 and the slide rail 105 of the recording medium moving unit 7, and is connected to a drive unit of the maintenance unit 310 and the carriage motor 102 of the transport belt 101.

The inkjet recording unit 4 is filled with the ink I from the ink cartridge 81 when the inkjet recording apparatus 1 initially performs a printing operation. To fill the inkjet recording unit 4 with the ink I, the microcomputer 510 returns the inkjet recording unit 4 to the standby position and allows the maintenance unit 310 to rise in the arrow D direction to cover the nozzle plate 52. The microcomputer 510 drives the ink supply pump 71*b* to transport the ink I to the ink collection chamber 71 from the ink cartridge 81. When the ink I reaches the liquid transport hole 71*c* in the ink collection chamber 71, the microcomputer 510 adjusts the pressure of the ink in the ink casing 70 using the pressure adjustment unit 90 and drives the circulation pump 77. The microcomputer 510 completes the initial filling with the ink I when the ink I reaches the liquid transport hole 71*c* of the ink collection chamber 71 and the exhaust hole 72*b* of the ink supply chamber 72.

The inkjet recording apparatus 1 initially fills the inkjet recording units 4*a*, 4*b*, 4*c*, 4*d*, and 4*e* respectively with the cyan ink, the magenta ink, the yellow ink, the black ink, and the white ink from the ink cartridges 81*a*, 81*b*, 81*c*, 81*d*, and 81*e*.

After the initial filling of the ink I is completed, the pressure of the ink inside the ink casing 70 is maintained to be negative such that the ink I is not discharged from the nozzles 51 of the inkjet head 2, and the air is not sucked from the nozzles 51. The negative pressure of the ink in the ink casing 70 allows the nozzles 51 to maintain the meniscus 290. The negative pressure is a negative pressure when the atmospheric pressure is assumed to be zero. The ink casing 70 is airtight even when the power of the inkjet recording apparatus 1 through the power supply unit 550 is turned off after the initial filling with the ink I is completed. Accordingly, the meniscus 290 in the nozzles 51 maintains the negative pressure, and ink is prevented from being discharged.

When printing starts, the microcomputer 510 controls the recording medium moving unit 7 to fix the recording medium S on the table 103 by the suction and controls the table 103 to reciprocally move in the arrow B direction. The microcomputer 510 moves the maintenance unit 310 in the arrow C direction, and controls the carriage motor 102 to transport the carriage 100 in a direction toward the recording medium S so as to reciprocally move the carriage 100 in the arrow A direction.

The microcomputer 510, for example, selectively drives the actuator 54 of the inkjet head 2 according to an image signal corresponding to an image data that the memory 520 stores and controls the inkjet head 2 to discharge the ink droplets ID onto the recording medium S from the nozzles 51. The microcomputer 510 drives the circulation pump 77 to circulate the ink I that flows from the inkjet head 2 back to the inkjet head 2 via the ink collection chamber 71, the filter 78, and the ink supply chamber 72. Circulating the ink I allows the inkjet recording unit 4 to remove bubbles or foreign bodies that are included in the ink I and to maintain the ink discharge performance thereof. Therefore, the quality of the image printed by the inkjet recording unit 4 is maintained.

Discharging the ink droplets ID from the nozzles 51, driving the circulation pump 77, or the like changes the pressure of the ink in the ink casing 70. The microcomputer 510 adjusts the pressure of the ink in the ink casing 70 to be maintained in a stable range so that the ink is not discharged from the nozzles 51 or the air is not sucked from the nozzles 51. The microcomputer 510 controls the pressure adjustment unit 90 or the ink supply pump 71*b* to adjust the pressure of the ink in the ink casing 70.

The pressure of the ink in the ink collection chamber 71, for example, is decreased when the ink droplets ID are discharged from the nozzles 51 during printing because the amount of ink in the ink casing 70 is momentarily decreased. When the first pressure sensor 91*b* detects the decrease in the pressure of the ink in the ink collection chamber 71, the microcomputer 510 drives the pressure adjustment unit 90 or the ink supply pump 71*b* based on the detection result from the first pressure sensor 91*b*, the second pressure sensor 92*b*, the first ink amount sensor (liquid surface sensor) 88*a*, and the second ink amount sensor (liquid surface sensor) 88*b*. When the pressure applied to the ink at the nozzles 51 is not in a stable range, the microcomputer 510 adjusts the pressure applied to the ink at the nozzles 51 by taking the external air into the ink casing 70 or introducing new ink into the ink collection chamber 71, depending on the height of the first liquid surface $\alpha$1 or the second liquid surface $\alpha$2.

Adjustment of the pressure applied to the ink at the nozzles 51 will be described with reference to FIG. 9 and FIG. 10. For example, Pt1 is the lower limit value, and Pt2 is the upper limit value of a stable range of a pressure value P in the nozzles 51. The stable range of the pressure value P is where the ink is not discharged from the nozzles 51, or the air is not sucked from the nozzles 51 in the inkjet recording unit 4. The microcomputer 510 performs pressure adjustment of the inside of the ink casing 70 when the pressure value P of the ink at the nozzles 51 is lower than the lower limit value Pt1 after the power supply unit 550 is turned on at a time t1, as illustrated in FIG. 9.

The pressure adjustment is an adjustment process performed by taking the external air into the ink casing 70 or introducing the ink into the ink collection chamber 71 from the ink cartridge 81. The microcomputer 510 stops the pressure adjustment when the pressure value P of the ink at the nozzles 51 reaches a value in the range of the lower limit value Pt1 to the upper limit value Pt2 at a time t2. The ink casing 70 is refilled with new ink to adjust the pressure of the ink at the nozzles 51. That is, the inkjet recording unit 4 refills the ink collection chamber 71 with new ink during the pressurization adjustment of the ink at the nozzles 51 while printing operation is performed through discharging the ink I from the nozzles 51.

Figure 9:
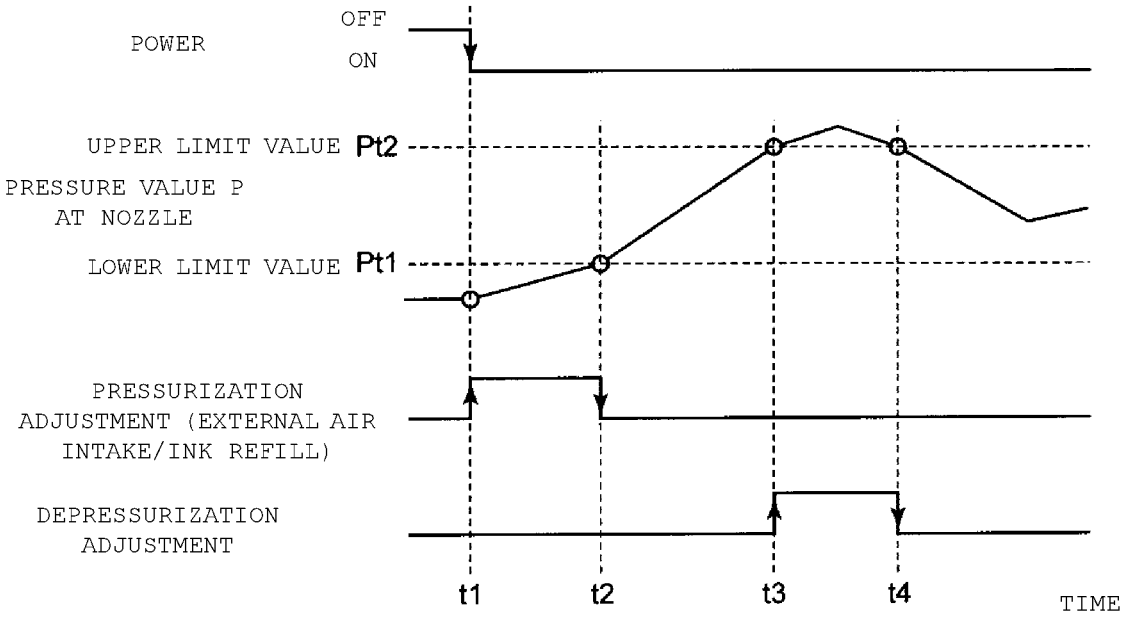
FIG. 9 is a timing chart illustrating adjustment of a pressure applied to the nozzle according to the embodiment.

The microcomputer 510 performs depressurization adjustment of the nozzles 51 by exhausting the air in the ink casing 70 outward when the pressure value P of the nozzles 51 exceeds the upper limit value Pt2 at a time t3 in FIG. 9. The microcomputer 510 stops the depressurization adjustment when the pressure value P of the ink at the nozzles 51 reaches a value in the range of the lower limit value Pt1 to the upper limit value Pt2 at a time t4.

Figure 10:
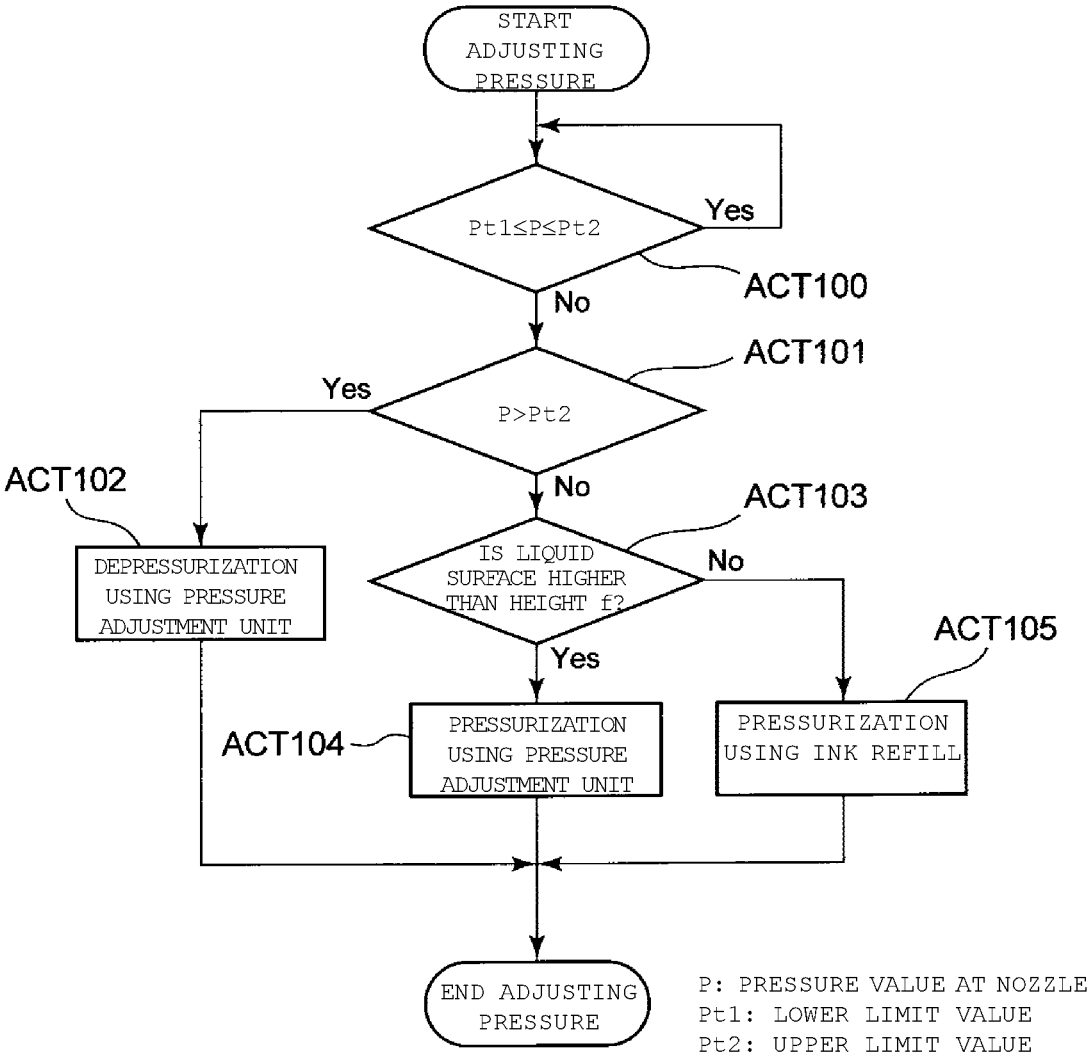
FIG. 10 is a flow chart of the pressure adjustment carried out according to the embodiment.

The microcomputer 510 starts adjusting the pressure of the ink at the nozzles 51 according to a flow chart in FIG. 10 when the power of the inkjet recording apparatus 1 is turned on. The microcomputer 510 determines whether or not the pressure value P of the ink at the nozzles 51 is in a range of Pt1≤P≤Pt2 based on the detection result from the first pressure sensor 91*b* and the second pressure sensor 92*b* (ACT100). The range of the pressure value P of the ink at the nozzles 51 may be determined based on the detection result from any of the first pressure sensor 91*b* and the second pressure sensor 92*b*.

When the pressure value P of the ink at the nozzles 51 is not in the range of Pt1≤P≤Pt2 (No in ACT100), the microcomputer 510 determines whether the pressure value P of the ink at the nozzles 51 is higher than the upper limit value Pt2 (ACT101). When the pressure value P of the ink at the nozzles 51 is lower than the upper limit value Pt2 (No in ACT101), the microcomputer 510 determines whether the first liquid surface $\alpha$1 and the second liquid surface $\alpha$2 are higher than a height f (ACT103). The height f is arbitrary, and is desirably higher than the liquid transport hole 71*c* and the exhaust hole 72*b* of the ink casing 70. The liquid surface compared with the height f may be any one of the first liquid surface $\alpha$1 and the second liquid surface $\alpha$2.

When the first liquid surface $\alpha$1 and the second liquid surface $\alpha$2 are higher than the height f (Yes in ACT103), the microcomputer 510 proceeds to ACT104. In ACT104, the microcomputer 510 drives the first pressure adjustment pump 91*a* and the second pressure adjustment pump 92*a* to take external air into the ink casing 70, thus performing the pressurization adjustment of the pressure of the ink at the nozzles 51. The microcomputer 510 completes adjusting the pressure of the ink at the nozzles 51 when the pressure value P of the ink at the nozzles 51 is in the range of Pt1≤P≤Pt2 in ACT104. The pressurization adjustment of the ink at the nozzles 51 may be performed by taking external air from any of the first pressure adjustment pump 91*a* and the second pressure adjustment pump 92*a* during the pressurization adjustment in ACT104.

When the first liquid surface α1 and the second liquid surface α2 are lower than or equal to the height f (No in ACT103), the microcomputer 510 proceeds to ACT105. In ACT105, the microcomputer 510 drives the ink supply pump 71*b* to supply the new ink I into the ink collection chamber 71 from the ink cartridge 81, thus performing the pressurization adjustment of the pressure of the ink at the nozzles 51. The microcomputer 510 completes adjusting the pressure of the ink at the nozzles 51 when the pressure value P of the ink at the nozzles 51 is in the range of Pt1≤P≤Pt2 in ACT105.

That is to say, when the pressure value P of the ink at the nozzles 51 is lower than the lower limit value Pt1 (No in ACT101), the microcomputer 510 operates to drive the first pressure adjustment pump 91*a* and the second pressure adjustment pump 92*a* or drive the ink supply pump 71*b* depending on the amount of ink in the ink casing 70, thus performing the pressurization adjustment on the pressure value P of the ink at the nozzles 51. When the amount of ink in the ink casing 70 is reduced during the pressurization adjustment, the microcomputer 510 operates to supply the new ink I into the ink casing 70 from the ink cartridge 81. The pressurization adjustment is performed on the pressure value P of the ink at the nozzles 51 by increasing the volume of the ink I in the ink casing 70. The ink I in the ink casing 70 maintains to have the height f. The inkjet recording unit 4 may supply the new ink I into the ink collection chamber 71 by performing the pressurization adjustment on the ink at the nozzles 51 without stopping the printing operation.

When the pressure value P of the ink at the nozzles 51 is higher than or equal to the upper limit value Pt2 in ACT101 (Yes in ACT101), the microcomputer 510 proceeds to ACT102. In ACT102, the microcomputer 510 drives the first pressure adjustment pump 91*a* and the second pressure adjustment pump 92*a* to exhaust air in the ink casing 70, thus performing the depressurization adjustment of the pressure of the ink at the nozzles 51. The microcomputer 510 completes adjusting the pressure of the ink at the nozzles 51 when the pressure value P of the ink at the nozzles 51 is in the range of Pt1≤P≤Pt2.

The inkjet recording unit 4 maintains the pressure value P of the ink at the nozzles 51 to be in the range of the Pt1≤P≤Pt2 to maintain the ink discharge characteristics of the nozzles 51 favorably. Therefore, the quality of the image is maintained. The inkjet recording unit 4 maintains the pressure value P of the ink at the nozzles 51 to be in the range of Pt1≤P≤Pt2 to prevent unnecessary ink discharge or the air sucking from the nozzles 51.

Adjusting the pressure of the ink at the nozzles 51 illustrated in FIG. 10 is performed all the time at any timing specified by the microcomputer 510.

According to the exemplary embodiment, the inkjet recording unit 4 removes bubbles or foreign bodies included in the ink I by circulating the ink I using the ink circulation device 3. The ink discharge performance of the inkjet head 2 is maintained favorably. Therefore, the quality of the image printed by the inkjet recording unit 4 is maintained.

According to the exemplary embodiment, the inkjet recording unit 4 operates to drive the first pressure adjustment pump 91*a* and the second pressure adjustment pump 92*a* or drive the ink supply pump 71*b* to perform the pressurization adjustment on the pressure value P of the nozzles 51. Switching between driving the first pressure adjustment pump 91*a* and the second pressure adjustment pump 92*a* and driving the ink supply pump 71*b* is performed depending on the height of the ink I in the ink casing 70. The first pressure adjustment pump 91*a* and the second pressure adjustment pump 92*a* are driven when the pressure value P of the ink at the nozzles 51 is lower than the lower limit value Pt1, and the height of the ink I in the ink casing 70 is higher than the height f. The pressurization adjustment is performed on the pressure value P of the ink at the nozzles 51 by taking external air into the ink casing 70 when the height of the ink I in the ink casing 70 is higher than the height f.

The ink supply pump 71*b* is driven when the pressure value P of the ink at the nozzles 51 is lower than the lower limit value Pt1, and the height of the ink I in the ink casing 70 is lower than or equal to the height f. The pressurization adjustment is performed on the pressure value P of the ink at the nozzles 51 by supplying new ink into the ink collection chamber 71 when the height of the ink I in the ink casing 70 is lower than or equal to the height f. The inkjet recording unit 4 may supply the new ink I into the ink casing 70 from the ink cartridge 81 even during the pressure adjustment in a printing operation. The inkjet recording unit 4 may supply the ink I into the ink casing 70 without stopping the printing operation while the pressure value P of the ink at the nozzles 51 is maintained. Thus, efficiency of printing by the inkjet recording apparatus 1 is not compromised to supply the ink.

The configuration of the above-described liquid circulation device of the exemplary embodiment is not limited. For example, the liquid chamber and the liquid discharge unit may not be integrated with each other provided that liquid may be circulated while liquid is supplied to the liquid chamber. In addition, the liquid circulation device may also discharge any liquid other than ink. For example, the liquid discharge apparatus that discharges liquid other than ink may be an apparatus that discharges liquid which includes conductive particles to form a wiring pattern for a printed circuit board or such kind of apparatuses.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid circulation device for circulating liquid through a head, comprising:

a liquid container including first and second chambers separated by a partition and communicable through a first hole formed on a wall of the first chamber and a second hole formed on a wall of the second chamber;

a circulation pump configured to convey the liquid out of the liquid container to the head and recover the liquid from the head into the liquid container;

a liquid pump configured to supply liquid into the first chamber through a third hole formed on the wall of the first chamber and positioned higher than the first hole;

an air pump configured to convey air into and out of the liquid container;

a controller configured to switch between the liquid pump and the air pump as a source for applying pressure to the liquid container;

a pressure sensor configured to detect pressure in the liquid container; and a liquid sensor disposed at a predetermined level of the liquid container, wherein the controller controls the liquid pump to supply liquid into the liquid container to increase the pressure in the liquid container when the detected pressure is lower than a threshold and the liquid sensor does not detect liquid, and the controller controls the air pump to convey the air into the liquid container to increase the pressure in the liquid container when the detected pressure is lower than the threshold and the liquid sensor detects liquid.

2. The liquid circulation device according to claim 1, wherein the liquid container includes an inlet formed on the first chamber and an outlet formed on the second chamber, and the circulation pump conveys the liquid out of the liquid container through the outlet to the head and collects the liquid from the head into the liquid container through the inlet.

3. The liquid circulation device according to claim 1, wherein upon the detected pressure increasing to the threshold, the controller controls either the liquid pump or the air pump to stop operation.

4. The liquid circulation device according to claim 1, further comprising:

a filter in a circulation path of the liquid between the circulation pump and the second chamber.

5. An inkjet device comprising:

a medium conveyer configured to convey a medium;

an inkjet head including a plurality of nozzles configured to discharge ink on the medium; and an ink circulation device configured to circulate the ink through the inkjet head, the ink circulation device including:

an ink container including first and second chambers separated by a partition and communicable through a first hole formed on a wall of the first chamber and a second hole formed on a wall of the second chamber, a circulation pump configured to convey the ink out of the ink container to the inkjet head and recover the ink from the inkjet head into the ink container, an ink pump configured to supply ink into the first chamber through a third hole formed on the wall of the first chamber and positioned higher than the first hole, an air pump configured to convey air into and out of the ink container, a controller configured to switch between the ink pump and the circulation pump as a source for applying pressure to the ink container, a pressure sensor configured to detect pressure in the ink container, and an ink sensor disposed at a predetermined level of the ink container, wherein the controller controls the ink pump to supply ink into the ink container to increase the pressure in the ink container when the detected pressure is lower than a threshold and the ink sensor does not detect ink, and the controller controls the air pump to convey the air into the ink container to increase the pressure in the ink container when the detected pressure is lower than the threshold and the ink sensor detects ink.

6. The inkjet device according to claim 5, wherein the ink container includes an inlet formed on the first chamber and an outlet formed on the second chamber, and the circulation pump conveys the ink out of the ink container through the outlet to the inkjet head and collects the ink from the inkjet head into the ink container through the inlet.

7. The inkjet device according to claim 5, wherein upon the detected pressure increasing to the threshold, the controller controls either the ink pump or the air pump to stop operation.

8. The inkjet device according to claim 5, wherein the ink circulation device further includes a filter in a circulation path of the ink between the circulation pump and the second chamber.

* * * * *